US006910796B2

(12) United States Patent
Bailey et al.

(10) Patent No.: US 6,910,796 B2
(45) Date of Patent: Jun. 28, 2005

(54) PROCESS AND EQUIPMENT FOR PRODUCING CONCRETE PRODUCTS HAVING BLENDED COLORS

(75) Inventors: Paul W Bailey, Sarasota, FL (US); Glenn C Bolles, Edina, MN (US); Jeffrey C. Bader, Edgewater, FL (US); David Matthew LaCroix, Circle Pines, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 352 days.

(21) Appl. No.: 10/127,861

(22) Filed: Apr. 22, 2002

(65) Prior Publication Data

US 2003/0197310 A1 Oct. 23, 2003

(51) Int. Cl.[7] ..... B28B 3/06; B28C 5/34; B28C 5/36; B28C 9/02

(52) U.S. Cl. ..... 366/40; 366/49; 366/2; 366/3; 366/13; 264/73; 264/74; 264/77; 264/245; 264/333; 425/130; 425/134; 425/204; 427/262; 427/263; 427/267; 427/268

(58) Field of Search ..... 264/73, 74, 77, 264/245, 333; 425/130, 134, 204; 366/2, 3, 13, 40, 49; 427/262, 263, 267, 268

(56) References Cited

U.S. PATENT DOCUMENTS

| | | | | | |
|---|---|---|---|---|---|
| 1,727,580 | A | * | 9/1929 | White | 264/426 |
| 1,829,187 | A | * | 10/1931 | Piessevaux | 162/119 |
| 2,328,058 | A | * | 8/1943 | Crabbs | 264/293 |
| 3,425,105 | A | | 2/1969 | Guide | 425/130 |
| 3,904,723 | A | * | 9/1975 | Prince | 264/71 |
| 4,050,864 | A | | 9/1977 | Komaki | 425/134 |
| 4,098,563 | A | * | 7/1978 | Prince | 425/204 |
| 4,178,340 | A | | 12/1979 | Hyytinen | 264/73 |
| 4,802,836 | A | | 2/1989 | Whissell | 425/253 |
| 5,056,998 | A | | 10/1991 | Goossens | 425/130 |
| 5,188,848 | A | * | 2/1993 | Taddei | 425/147 |
| 5,248,338 | A | * | 9/1993 | Price | 106/712 |
| 5,322,563 | A | * | 6/1994 | van Bonn et al. | 106/712 |
| 5,435,949 | A | | 7/1995 | Hwang | 264/51 |
| 5,534,214 | A | | 7/1996 | Sakamoto et al. | 264/333 |
| 5,651,912 | A | | 7/1997 | Mitsumoto et al. | 249/13.4 |
| 6,471,895 | B2 | * | 10/2002 | Metten | 264/71 |
| 2003/0198122 | A1 | * | 10/2003 | Johnson | 366/2 |

FOREIGN PATENT DOCUMENTS

| | | | | | |
|---|---|---|---|---|---|
| DE | 2 240 035 | A | | 2/1974 | B01F/13/10 |
| DE | 195 13 178 | A1 | | 10/1996 | B28B/13/02 |
| GB | 1353011 | A | * | 4/1974 | C04B/27/00 |
| JP | 03-147803 | A | * | 6/1991 | B28B/1/08 |
| JP | 9-38922 | A | | 2/1997 | B28B/3/02 |

OTHER PUBLICATIONS

JPO Abstract of JP 03–147803 A, 1998, Japanese Patent Office.*

(Continued)

*Primary Examiner*—Michael P. Colaianni
*Assistant Examiner*—Michael I. Poe
(74) *Attorney, Agent, or Firm*—Merchant & Gould P.C.

(57) ABSTRACT

A process and equipment for producing multi-color concrete products, including architectural concrete blocks, concrete bricks, modular concrete products that are suitable for use in landscaping applications, such as retaining wall blocks, concrete pavers, and concrete slabs. The invention includes a spray mechanism that sprays liquid pigment onto concrete discharged from a hopper. The concrete then proceeds to a blending mechanism which blends the pigment into the concrete to produce a multi-color concrete blend. The concrete blend is then used to produce multi-colored concrete products.

24 Claims, 5 Drawing Sheets

(1 of 5 Drawing Sheet(s) Filed in Color)

OTHER PUBLICATIONS

Derwent Abstract of DE 2240035 A, 1974, Derwent Information Limited, Derwent Week 197410.*
Derwent Abstract of DE 19513178 A1, 1996, Derwent Information Limited, Derwent Week 199645.*
Machine translation of JP 09–038922 A, Apr. 2004, Japanese Patent Office website.*
Color & Chemical Technologies, Inc., Technical Data Sheet, Mar. 2002, 1 page.
Besser Co., Founders Spray Machine, http://www.besser.com/equipment/productenhance/founderspray.htm, printed Jun. 2002, 2 pages.
Besser Co., Press Release dated Jan. 29, 2001, Founders Spray Machine, 1 page.

* cited by examiner

PROCESS AND EQUIPMENT FOR PRODUCING CONCRETE PRODUCTS HAVING BLENDED COLORS

FIELD OF THE INVENTION

The invention relates generally to the production of concrete products. More specifically, the invention relates to a production process in which one or more liquid pigments are blended into concrete so that the final product is not a uniform color, but has a variegated appearance that might be described as swirled, folded, or mottled. Most specifically, the invention relates to the production of such concrete products in a dry cast process. Concrete products to which the invention can be applied include, but are not limited to, architectural concrete blocks, concrete bricks, and concrete blocks that are suitable for use in landscaping applications, such as retaining wall blocks, pavers, and slabs.

BACKGROUND OF THE INVENTION

Concrete products can be produced without any coloring agents, in which case the resulting product will have a color dictated by the native colors of the raw materials, typically cement and aggregate, that have been used. The result is typically a shade of gray. It is possible to alter this gray color by introducing a coloring agent into the mixture. The coloring agent is typically a pigment, or a mixture of pigments, that will impart the desired color to the finished product.

There are a variety of known processes for making concrete products. In a wet cast system, a concrete mixture that contains sufficient water so that it flows readily is introduced into a closed mold. The mixture is allowed to harden in the mold, and the molded product is then stripped from the mold. In a dry cast system, a much drier concrete mixture is introduced into a mold. The concrete mixture is densified in the mold, and then removed from the mold before it has hardened. Because the concrete mixture is of a "low slump" or "no slump" nature, the molded product, if carefully handled, will retain its molded shape while it is transported to a curing area, where it will cure over a period of hours. This dry cast process is suitable for highly automated, mass production of a number of types of concrete products, including architectural concrete blocks, segmental retaining wall units, concrete bricks, slabs, and interlocking concrete pavers.

In recent years, it has become desirable to produce some of these products with variegated colors, rather than with uniform colors. The variegated color products will have two or more distinct colors visible in the finished product, with the colors folded, or swirled, or mottled in some fashion. This is a popular look in landscape products in particular, where the appearance of naturally-occurring, variegated colored stone is being sought. In this specification, the term "color blended" will be used to refer to such a variegated color appearance.

An example of a known dry cast concrete product production system 5 is illustrated in FIG. 1. The system 5 includes a mixer 6 in which a batch of the low slump concrete is mixed from known components. After mixing, the batch of uncured concrete is transported by a conveyor 7 to a surge hopper 8, with the concrete being deposited into the hopper 8. Uncured concrete is then metered from the hopper 8 onto a metering belt 9 which transports the metered amount of concrete to a production machine 10 which forms a plurality of concrete products from the concrete.

The production machine 10 includes a hopper 15 that receives the concrete from the metering belt 9. The production machine 10, as would be understood by a person having ordinary skill in the art, includes molds that are open at the top and bottom. A pallet is positioned below each mold to close the bottom of the mold, and the uncured concrete is delivered from the hopper 15 into each mold through the open top of the mold via one or more feed drawers. The uncured concrete is then densified and compacted by a combination of vibration and pressure. The mold is then stripped by a relative vertical movement of the mold and the pallet to remove the uncured concrete product from the mold. The uncured product is then transported to a location where it is cured. The production machinery needed to construct a system of this type is available from Besser Company of Alpena, Mich., as well as from a number of other sources, including Columbia Machine Company, Tiger Machine Company, Masa, Omag, Rikers, Hess, KVM, Zenith, and others. Batching and mixing equipment is available from a number of sources well known in the industry. Color pigments are available from a number of sources, including Bayer, Davis Color, and Hamburger Color Company.

Returning to FIG. 1, color blending has previously been achieved by preparing a batch of concrete of a first color and depositing a first colored concrete layer 11 in the hopper 8, preparing a batch of concrete of a second color and depositing a second colored concrete layer 12 in hopper 8 on top of the first layer of concrete 11, and, if a third color is desired, preparing a batch of concrete of a third color and depositing a third colored concrete layer 13 in hopper 8 on top of the second layer 12. For example, the first layer 11 can be black concrete, the second layer 12 can be brown concrete, and the third layer 13 can be gray concrete. Blending of the three colors occurs within the hopper 8, as the concrete is metered from the hopper 8 onto the metering belt 9, on the metering belt 9 itself, and within the production machine 10 prior to being introduced into the molds.

A difficulty with this previous blending process is that the blending of the different colors, and the resulting color blended look of the concrete product, are not controllable. The initial amount of concrete that is metered from the hopper 8 onto the belt 9 is mostly a single color from the layer 11. Therefore, concrete products made from the initial amount of concrete will have little or no color blending, and as a result, will have an appearance that is significantly different from concrete products that are formed from later metered amounts of concrete. These initial products are often discarded due to insufficient blending. In addition, the final amount of concrete from the hopper 8 is often primarily a single color from the layer 13, so that products made from this final amount are also frequently discarded.

Further, the color blending that does occur in the hopper 8 and downstream from the hopper is random, as is the amount of each color contained in the concrete that is metered from the hopper 8 onto the belt 9. Therefore, products produced from one metered amount of concrete may have one look, while products produced from another metered amount of concrete may have an entirely different look. This can be a problem when it is desired to achieve a somewhat consistent color blended appearance.

In addition, the design of the hopper 8 is such that the entire amount of concrete must be used up before new color layers 11–13 can be introduced. Therefore, if the decision is made to change the blended look of the products while concrete remains in the hopper 8, it is generally necessary to use up the remaining concrete in the hopper, or discard the remaining concrete entirely. The need to use up all of the concrete in the hopper 8 also slows down production, since the mixer 6 must then form each new colored batch for introduction into the hopper 8. While the hopper is being refilled, the production machine 10 may be standing idle waiting for filling to be complete and for new concrete to be metered from the hopper.

Moreover, due to the relatively long time the colors are in contact with each other, the colors can bleed together and produce areas on the resulting products having a color that is a mixture of two or more colors. This bleeding of colors can detract from the appearance of the product, by blurring the colors at the junctures between colors, which blurs the separation between colors in the resulting product.

Accordingly, there is a need for an improved process and equipment for producing color blended concrete products, in which there is more control of the resulting color blended appearance of the products, so that the appearance is generally repeatable, and at the same time reducing the amount of waste and reducing production down time.

SUMMARY OF THE INVENTION

The invention relates to a process and equipment for high speed, mass production of concrete products formed from concrete having one or more colors blended into the concrete. The concrete is preferably a multi-color blend that results in multi-colored concrete products. Preferably, the invention is used to produce concrete products that are suitable for use in landscaping applications, such as retaining wall blocks. The invention can also be used to produce color blended pavers, slabs, and bricks. The visible surfaces of a concrete product resulting from the multi-color blend have a variegated appearance which is generally repeatable, and which, in the case of landscape products, may simulate natural stone or rock.

With the present invention, the amount of each pigment added to the concrete to produce the multi-color blend is precisely controllable. As a result, a more consistent multi-color blend in the concrete can be achieved, so that the color blended appearance of the concrete products is more consistent and repeatable, and the production of one-color, or otherwise insufficiently color blended products, is reduced. The need to discard product due to insufficient color blending is therefore reduced. Further, the colors that are used in the multi-color blend can easily be changed, so that the resulting appearance of the visible surfaces of the concrete products can be readily altered.

In a preferred embodiment, liquid pigment is applied to concrete that is discharged from a hopper. Two or more different pigment colors are preferably applied onto the concrete by a spraying mechanism. The concrete then proceeds to a blending mechanism which blends the applied pigments into the concrete, resulting in a multicolor concrete blend. The concrete blend is then deposited into a hopper of a production machine, which forms one or more multi-color concrete products from the multi-color concrete blend.

The spraying mechanism preferably includes spray nozzles that are adjustable vertically in a direction toward and away from the concrete, as well as horizontally in a direction transverse to the direction of conveyance of the concrete. The spray pressure of the spray nozzles can also be adjusted. In addition, the blending mechanism preferably includes a pair of rotatable stirring mechanisms that have adjustable rotation speeds, and which are adjustable vertically in a direction toward and away from the concrete, as well as horizontally in a direction transverse to the direction of conveyance.

The settings of the nozzles, i.e. the positions of the nozzles relative to the concrete, and the spray pressure, and the settings of the stirring mechanisms, i.e. the positions of the stirring mechanisms relative to the concrete, and the rotation speeds, impact the blending of the pigments into the concrete. Changing any one of the settings changes the blending that occurs. However, once a desirable color blended appearance in a product has been achieved, the color blended appearance can be repeated by retaining the settings of the nozzles and the stirring mechanisms. Thus, a consistent multi-color appearance of the product can be achieved.

The process and equipment of the invention results in a reduction of concrete waste by eliminating the need to discard concrete from the hopper when a change in the multi-color appearance of the products is desired. The invention further results in a reduction in production stoppages, as the hopper can be filled with additional concrete as it runs low on concrete.

BRIEF DESCRIPTION OF THE DRAWINGS

The patent or application file contains at least one drawing or photograph executed in color. Copies of this patent or patent application publication with color drawing(s) will be provided by the United States Patent and Trademark Office upon request and payment of the necessary fee.

DETAILED DESCRIPTION OF THE PREFERRED EMBODIMENT

Overview

The present invention provides a process for producing multi-color blended concrete products, as well as to a system and equipment utilized in implementing the process. As used in this specification, the term "concrete products" includes architectural concrete blocks that are assembled with mortar to build external walls, concrete bricks, modular concrete products that are suitable for use in landscaping applications, such as retaining wall blocks, concrete pavers, concrete slabs, and other concrete products.

The preferred application of the process, system and equipment is in the dry cast production of blocks that are used in landscaping applications, particularly retaining wall blocks that are designed to be stacked on top of one another in multiple courses to form a retaining wall, without the use of mortar.

Figure 1:
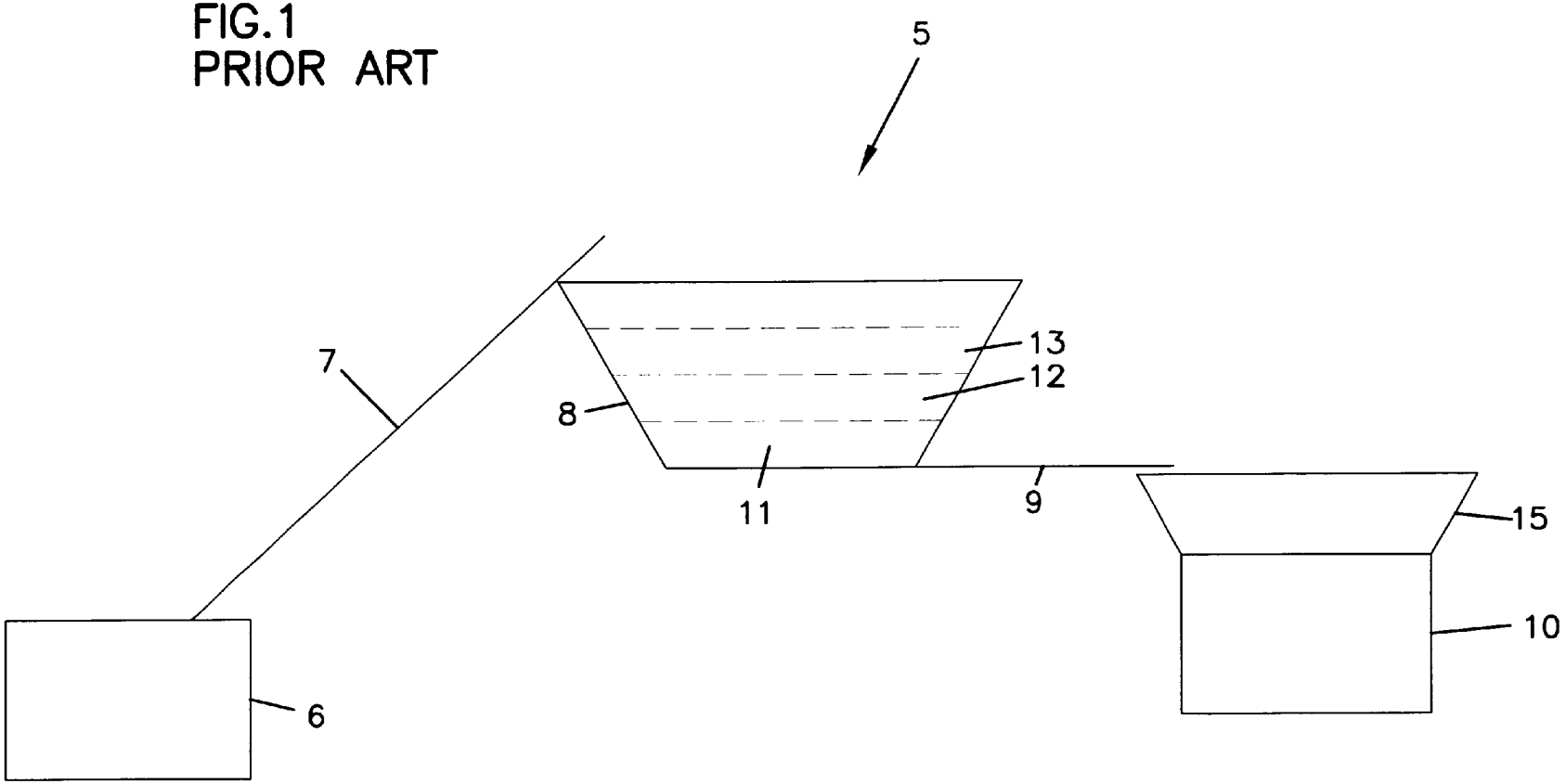
FIG.1 PRIOR ART
FIG. 1 is a schematic depiction of a known dry cast concrete product production system.
Figure 2:
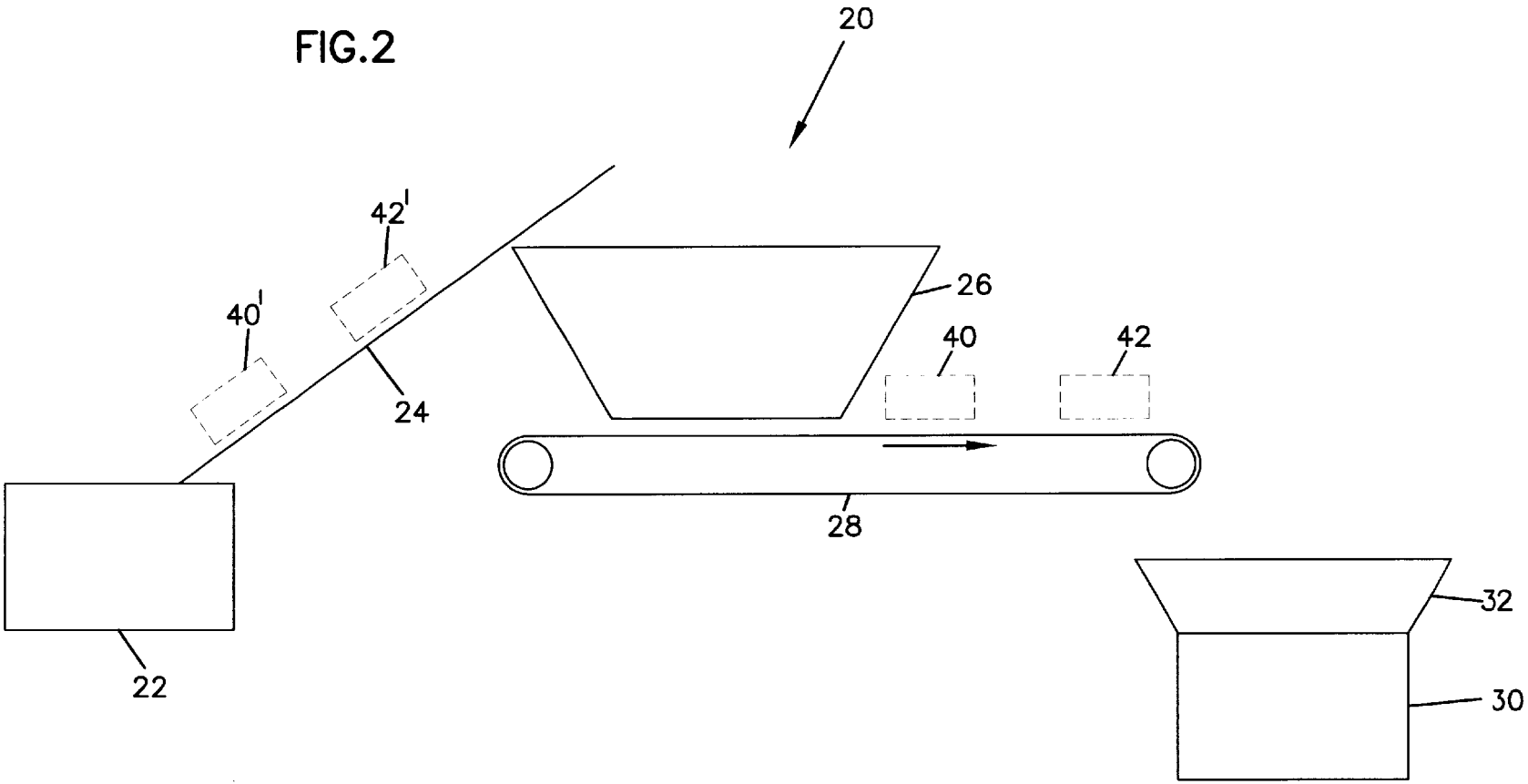
FIG. 2 is a schematic depiction of a dry cast concrete product production system according to the present invention.

FIG. 2 illustrates a dry cast production system 20 according to the present invention. The system 20 includes a hopper 22, which comprises a mixer that mixes batches of concrete. The components used to form the concrete, and the ratios of the components, may vary depending upon the particular application, and the particular mix designs are within the ordinary skill in the art. The components are typically aggregates such as sand and gravel, cement and approximately 5% by weight of water. Other components, depending upon the application, may include pumice, quartzite, taconite, and other natural or man-made fillers, and chemicals to improve such properties as water resistance, cure strength, and the like. The concrete mixed in the mixer 22 may also contain color pigment(s) to color the concrete to a base color. The ratios of various ingredients and the types of materials can be selected within the skill of the art and are often chosen based on local availability of raw materials, technical requirements of the end products, and the type of production machine being used. The mixer itself may be of any known type presently used in the industry, including pan-type mixers and ribbon-type mixers. In a currently preferred embodiment, the mixer is of the pan-type.

After the concrete is mixed, the concrete batch is transported from the mixer 22 by an infeed conveyor 24 to a surge hopper 26 which holds the concrete. The surge hopper 26, which is of conventional construction, includes a plurality of sidewalls and a bottom wall defining an interior volume. A discharge opening is formed adjacent the bottom of the hopper 26, through which concrete is to be discharged from the hopper. The discharge opening is controlled by a gate. The gate controls or meters concrete from the hopper through the discharge opening and onto a conveyor 28 which preferably comprises a metering belt. The conveyor 28 then carries the concrete from the hopper 26 to a production machine 30 which includes a hopper 32 into which the concrete is deposited. The production machine 30 then forms a plurality of blocks from the concrete.

As shown schematically in FIG. 2, a liquid pigment spray mechanism 40 is positioned between the surge hopper 26 and the hopper 32. The spray mechanism 40 is designed to apply one or more liquid pigments to the concrete on the conveyor 28 as the concrete is being transported by the conveyor 28 to the production machine 30. In the preferred embodiment, the spray mechanism 40 applies two or more differently colored liquid pigments to the concrete. The description hereinafter will discuss the application of two differently colored pigments to the concrete. However, a single liquid pigment color or more than two could be applied to the concrete, if desired.

FIG. 2 also schematically illustrates a blending mechanism 42 positioned between the spray mechanism 40 and the hopper 32 of the production machine 30. After the liquid pigments are applied to the concrete, the conveyor 28 delivers the concrete to the blending mechanism 42 which blends the liquid pigments into the concrete to produce a multi-color concrete blend. The concrete blend is then deposited into the hopper 32 of the production machine 30. One or more multi-color blocks are then produced from the multi-color blend.

Figure 3:
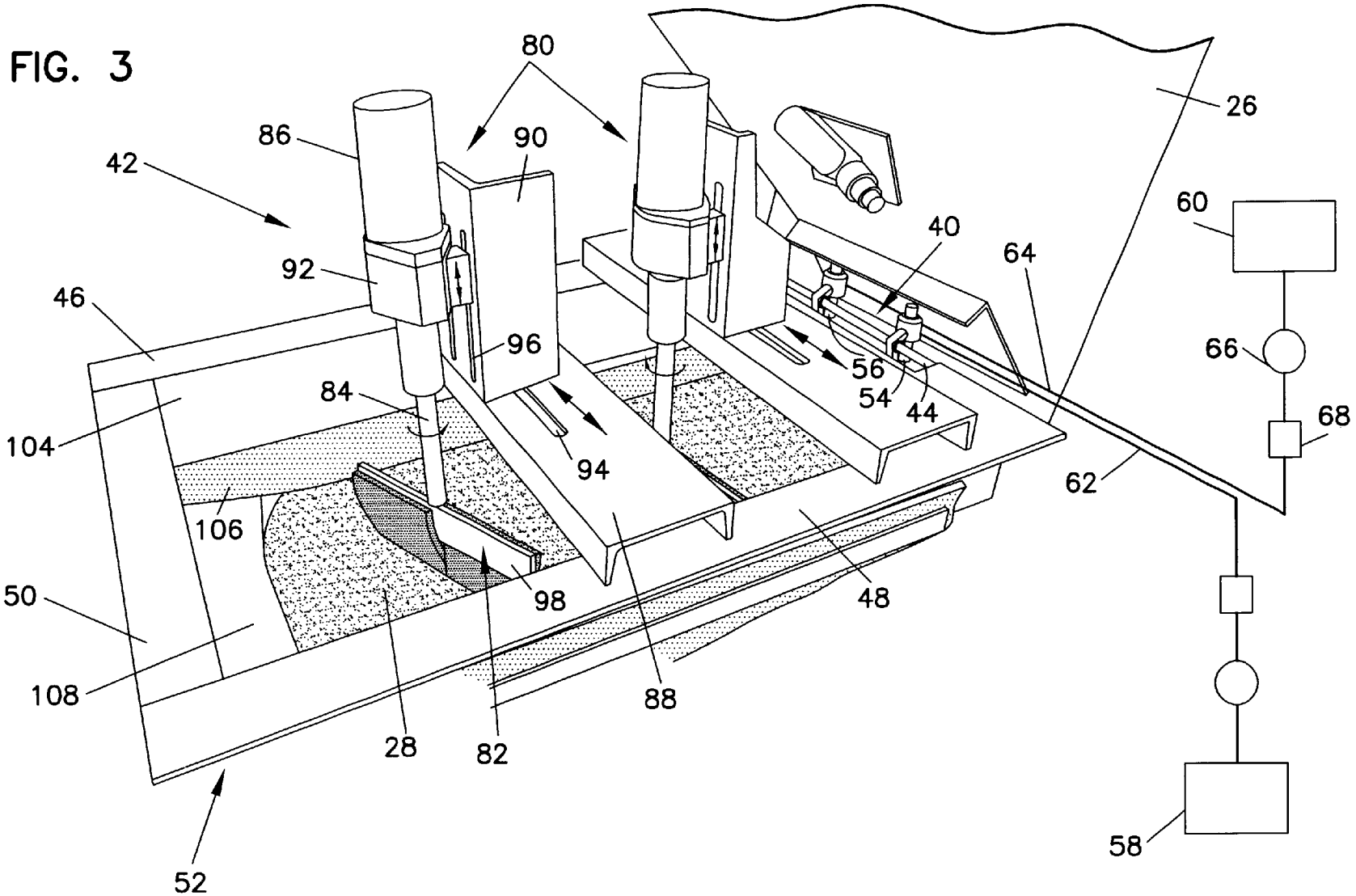
FIG. 3 is a perspective view of the liquid pigment spray mechanism and the blending mechanism positioned relative to the concrete conveyor in the production system.

With reference to FIG. 3, the spray mechanism 40 comprises a support bar 44 that extends between, and is connected to, a pair of longitudinal frame elements 46, 48. The frame elements 46, 48, together with transverse frame element 50 at the end of the frame elements 46, 48, form a portion of a frame 52 that is mounted in relation to the conveyor 28 so as to support the spray mechanism 40 and the blending mechanism 42.

A pair of spray nozzles 54, 56 are mounted at spaced locations on the support bar 44. Each color to be added to the concrete requires a separate spray nozzle. Therefore, for two pigment colors, at least two spray nozzles 54, 56 are used; for three pigment colors, at least three spray nozzles would be used; etc. There could also be more than one spray nozzle for each pigment color.

The spray nozzles 54, 56 point downward toward the conveyor 28 for spraying liquid pigments onto the concrete that is discharged from the hopper 26 onto the conveyor. The pigments are preferably sprayed onto portions of the upper surface of the concrete on the conveyor 28 as the concrete is transported by the conveyor toward the production machine 30. Because the nozzles 54, 56 are spaced apart from each other, the respective pigment colors from each nozzle will be applied to different portions of the concrete.

The spraying of pigment onto the concrete can be continuous, so that the pigment is applied to the upper surface of the entire concrete portion. Alternatively, spraying can be intermittent, in which case pigment will be applied to spaced portions of the upper surface of the concrete. In addition, the spray nozzles 54, 56 can operate simultaneously, in which case different colors are applied simultaneously, or in alternating fashion, in which case a first pigment color is applied, then a second pigment color is applied, then the first pigment color is again applied, etc. Numerous sequences of pigment application are possible within the scope of the invention. The specific spraying sequence chosen will impact the resulting concrete color blend and the concrete products produced therefrom. In the preferred embodiment, the spraying is continuous, and the spray nozzles are operated simultaneously.

Each spray nozzle 54, 56 is connected to a source of liquid pigment 58, 60 by flow lines 62, 64. In the preferred embodiment, the pigment is SPR 9000 series color available from Hamburger Color Company of King of Prussia, Pa. Included in each flow line 62, 64 is a pump 66 that pumps liquid pigment from the source 58, 60 to the spray nozzles 54, 56. The pump 66 is preferably an air driven pump with a regulator to allow adjustment of the delivery pressure of the pigment. It is believed that the delivery pressure of the pigment impacts the blending of the concrete and the resulting appearance of the concrete products. Delivery pressures of between about 40 psi and about 100 psi have been tested successfully. However, other delivery pressures could be used, depending upon the desired product appearance. The ratio of the amount of pigment to the amount of concrete to which it is applied, i.e. the color loading, is between about 1% to about 10%. For example, about 37.5 lbs. of pigment added to about 1250 lbs of concrete, providing a color loading of about 3%, has achieved satisfactory results.

A valve 68 in each flow line 62, 64 controls the flow of pigment to the spray nozzles 54, 56. The valves 68 are controlled in a known manner to result in the continuous, intermittent, simultaneous, and/or alternating application of pigment discussed above.

Each spray nozzle 54, 56 is also mounted so as to be adjustable along the length of the support bar 44. This allows adjustment of the spray nozzles 54, 56 in a direction transverse to the transport direction of the conveyor 28, which results in a change in the locations on the surface of the metered concrete where the pigments are applied. The spray nozzles 54, 56 are also preferably mounted so as to be adjustable toward and away from the conveyor 28. It is believed that the position of the spray nozzles 54, 56 relative to the concrete, both horizontally and vertically, also impacts the blending of the concrete and the resulting appearance of the concrete products.

Figure 4:
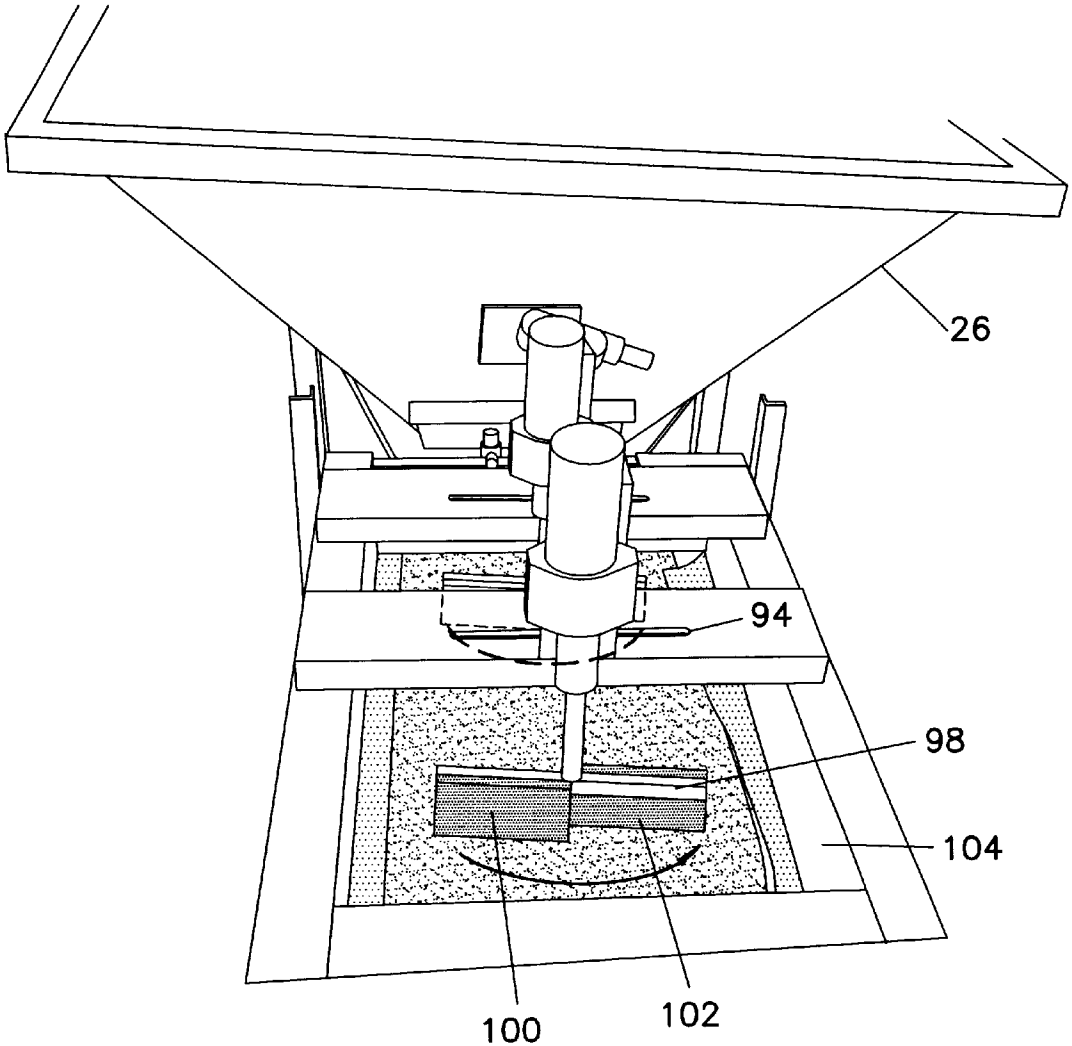
FIG. 4 is an elevated perspective view illustrating the liquid pigment spray mechanism and the blending mechanism position relative to the conveyor, viewed from the end of the conveyor.

After the metered concrete is transported by the conveyor 28 under the spray mechanism 40, the concrete enters the blending mechanism 42 which blends the pigments into the concrete. The blending mechanism 42, as best shown in FIGS. 3 and 4, comprises at least one, and preferably two, stirring mechanisms 80. The stirring mechanisms 80 are illustrated as being generally in-line with each other. The stirring mechanisms 80 are identical, except for the preferred direction of rotation of each, as will be discussed below. Therefore, only one stirring mechanism will be described in detail, it being understood that the other stirring mechanism is the same.

With reference to FIGS. 3 and 4, the stirring mechanism 80 comprises a stir paddle 82 connected to a shaft 84 which is in driving engagement with a variable speed drive motor 86. The drive motor 86 is preferably a hydraulic motor. A valve is used to control fluid flow to the hydraulic motor, thereby controlling the rotation speed of the stir paddle. A color coded flow control valve, model EF30S Easy Read available from Deltrol Corporation, can be used. However, other variable speed drive motor types could be used, including an electric motor. The drive motor 86 is designed to rotate the paddle 82 as the concrete is transported by the conveyor 28. As the concrete approaches each stirring mechanism 80, the concrete is stirred by the paddle 82, which blends or stirs the pigments into the concrete. The paddle 82, which is adjustable vertically relative to the conveyor 28 as discussed below, is positioned such that it is able to contact the concrete during rotation.

The stir mechanism 80 is mounted above the conveyor 28 on a transverse support bar 88 that extends between, and is attached to, the frame elements 46, 48. In addition, a vertical support element 90 is supported on, and extends upwardly from, the support bar 88, and a support block 92, disposed between the drive motor 86 and the shaft 84, is mounted to the support element 90.

As shown in FIG. 3, the support bar 88 includes an elongated adjustment slot 94 that extends transverse to the direction of the conveyor 28. The slot 94 permits adjustment of the support element 90, and thus adjustment of the stirring mechanism 80, in a horizontal or transverse direction relative to the conveyor 28. In addition, the support element 90 includes an elongated adjustment slot 96 that extends vertically relative to the conveyor 28. The slot 96 permits adjustment of the support block 92, and thus adjustment of the stirring mechanism 80, in a vertical direction relative to the conveyor 28.

Both the vertical and horizontal positions of the stirring mechanism 80 are believed to have an impact on the blending of the pigments into the concrete. By adjusting the horizontal and vertical positions of the stirring mechanism 80, the location of the stirring mechanism relative to the concrete is altered, which alters the resulting blending of the pigment into the concrete and the resulting appearance of the blocks. The particular vertical and horizontal positions chosen will be dependent upon the desired appearance of the blocks.

The speed of rotation of the paddle 82 also impacts the blending that occurs. The use of a variable speed motor 86 permits the speed of rotation to be changed, thereby changing the blending that results. Thus, the rotation speed can be selected based upon the desired appearance of the blocks.

Returning now to FIGS. 3 and 4, the paddle 82 comprises a rigid bar 98 that is connected to the drive shaft 84 and which extends substantially the entire length of the paddle 82. Rubber plates 100, 102 are fixed to the bar 98 and extend a distance below the bar 98 to form a generally continuous rubber plate extending beneath the bar 98. The rubber that is used to form the plates 100, 102 is preferably rigid enough to enable the paddle 82 to stir concrete when rotated, yet soft enough to prevent damage to the conveyor 28 in the event the paddle 82 comes into contact with the conveyor.

The length of the paddle 82 is preferably sufficient to allow the paddle to extend across almost the entire width of the conveyor 28, yet allow room for horizontal adjustment of the stirring mechanism. For example, on a conveyor that is about 14.0 inches wide, a paddle length of about 12.0 inches, has been tested successfully. Because of the length of the paddle, almost the entire width of the concrete on the conveyor 28 is impacted by the rotation of the paddle.

The preferred embodiment of the blending mechanism 42 has been described as utilizing a pair of stirring mechanisms 80. However, other blending mechanisms could be used to blend the pigments into the concrete.

To maintain the concrete on the conveyor 28 as the stirring mechanism 80 stirs the concrete, the frame 52 is provided with skirt elements 104 that project downwardly from the frame elements 46, 48. When the frame 52 is mounted in position, the bottom edges of the skirt elements 104 are positioned closely adjacent the top surface of the conveyor 28, as illustrated in FIG. 3, in order to maintain concrete on the conveyor as the concrete proceeds through the stirring mechanisms. A bottom edge portion 106 of each skirt element 104 is formed of rubber to prevent damage to the conveyor 28 in the event the skirt elements come into contact with the conveyor.

As discussed above, the stirring mechanisms 80 are identical, except for their preferred direction of rotation. The direction of rotation also impacts the blending of the pigment into the concrete. The stirring mechanisms 80 preferably rotate in opposite directions, as shown by the arrows in FIG. 3. However, a different multi-color appearance on a resulting product can be achieved by rotating the stirring mechanisms 80 in the same direction. Further, the direction of rotation of the stirring mechanisms could be periodically reversed.

After the concrete is conveyed through the blending mechanism 42, a gap 108 between the end of the conveyor 28 and the frame element 50 permits the multi-color concrete blend to be deposited into the hopper 32 of the production machine 30.

A preferred sequence of preparing a multi-color concrete blend for use by the production machine 30 will now be described. This sequence assumes that there is a sufficient amount of concrete in the hopper 26 to be discharged to the hopper 32. The hopper 32 contains a probe which senses when the production machine 30 is running low on concrete and can accept additional concrete. When the concrete in the hopper 32 is low, the probe sends a signal to the hopper 26. The conveyor 28 is then started and the hopper 26 starts discharging concrete onto the conveyor. Spraying of the pigments commences as soon as the conveyor starts, and spraying continues as long as the conveyor is operating.

Once the hopper 26 has discharged enough concrete to refill the hopper 32, the hopper gate is closed, thereby preventing further concrete discharge, and the conveyor is stopped. Spraying ends as soon as the conveyor stops. If desired, the starting and stopping of spraying can operate on time delays, based upon the opening and closing of the hopper gate, and the speed of the conveyor 28. Alternatively, a sensor can be provided adjacent the spraying mechanism 40 for sensing the leading and trailing ends of the metered concrete portion, thereby controlling operation of the spray mechanism.

Therefore, the concrete in the hopper 26 can be continuously replenished as needed, without having to stop production to fill the hopper 26. Further, when a decision is made to change the multi-color blended appearance of the blocks, this can be accomplished without having to empty the hopper 26.

After the pigments are applied to the concrete, the concrete proceeds through the two stirring mechanisms 80 which blend the pigments into the concrete. After blending, the multi-color concrete blend is then deposited into the hopper 32.

The multi-color concrete blend in the hopper 32 is used to produce one or more blocks in the production machine 30. To produce blocks, a pallet is positioned below a retaining wall block mold, having an open top and bottom, in the production machine 30 to close the open bottom of the mold. The mold cavity can be designed to produce a workpiece that comprises a pair of blocks molded in face to face arrangement, with the workpiece being split after it is cured along the line of intersection of the faces to produce two blocks.

The multi-color blended concrete is delivered from the hopper 32 into the mold through the open top of the mold via one or more feed drawers. The concrete is then densified and compacted by a combination of vibration and pressure. The mold is then stripped by a relative vertical movement of the mold and the pallet to remove the uncured workpiece from the mold. A discussion of a retaining wall block mold that can be used with the present invention, along with a discussion of the block molding process, can be found in U.S. Pat. No. 5,827,015, which is incorporated herein by reference.

The uncured workpiece is then transported away to be cured, after which the workpiece is split in known manner to produce two blocks. Splitting mechanisms are known in the art. An example of a splitting mechanism that could be used with the invention includes U.S. Pat. No. 6,321,740, which is incorporated herein by reference.

Figure 5:
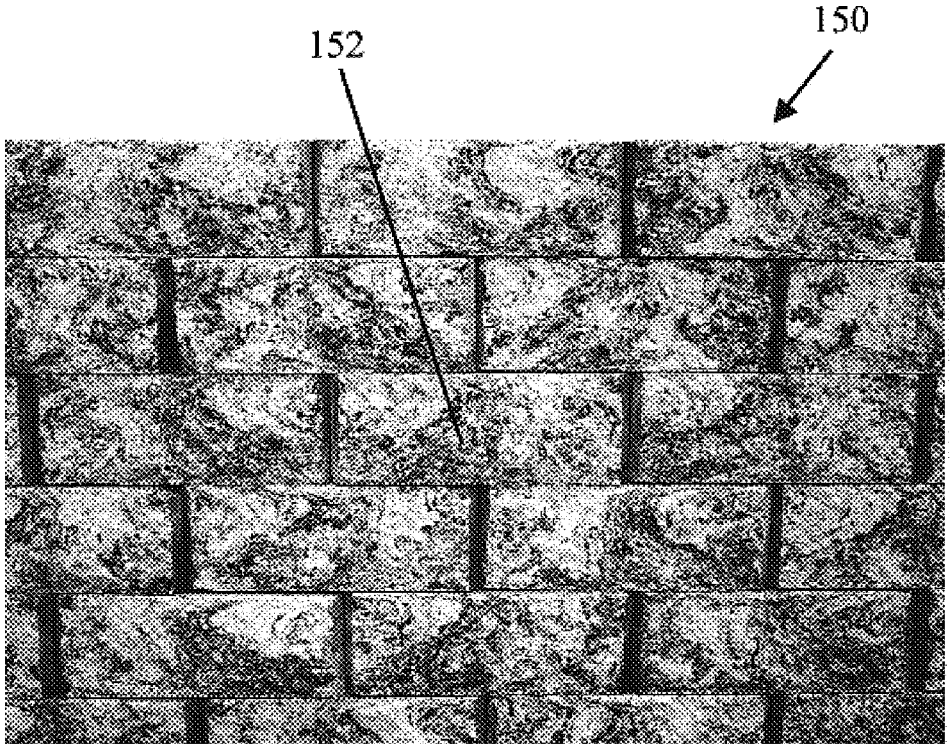
FIG. 5 is a color photograph of a plurality of concrete blocks produced according to the invention and stacked into courses to form a wall.

FIG. 5 is a color photograph of a portion of a wall 150 that is constructed from a plurality of multi-color concrete blocks 152 produced using the process and equipment of the present invention. Each block 152 includes a split front face that results from a splitting operation that occurs on a workpiece that comprises two of the blocks formed face to face as discussed above.

The blocks 152 illustrated in FIG. 5 were produced from a multi-color blended concrete comprising white colored base concrete to which was added red and black pigments. The following settings were used:

1) for the stirring mechanism 80 closest to the hopper 26, the motor 86 was driven at about 8 rpm on the blue setting of the Deltrol Corp. EF30S Easy Read color coded flow control valve, the paddle was rotated in a counterclockwise direction, and the stirring mechanism was shifted in the slot 94 as far to the right as possible when viewing FIG. 4;

2) for the stirring mechanism 80 closest to the hopper 32, the motor 86 was driven at about 102 rpm on the purple setting of the Deltrol Corp. EF30S Easy Read color coded flow control valve, the paddle was rotated in a clockwise direction, and the stirring mechanism was shifted in the slot 94 as far to the left as possible when viewing FIG. 4;

3) for each stirring mechanism, the paddle was positioned so that its bottom edge was positioned closely adjacent the surface of the conveyor 28; and 4) the black pigment was sprayed onto the concrete at a pressure of 60 psi, and the red pigment was sprayed onto the concrete at a pressure of 40 psi.

The motor speeds were obtained at a hydraulic pressure of 400 psi using a vicker's piston pump with an adjustabe compensator.

By keeping the same nozzle and stirring mechanism settings, the blending of the pigments into the concrete can be consistently repeated, and a consistent appearance of the blocks can be achieved. If a different appearance is desired, one or more of the settings can be changed, thereby changing the blending that occurs, and changing the resulting appearance of the multi-color block.

The shape of the block 152 can take many forms, depending upon the intended end use of the block. For example, the block 152 can include converging side walls, and an integral locator/shear flange(s) formed on the top and/or,bottom face of the block. U.S. Pat. No. 5,827,015 discloses examples of blocks that could be formed utilizing the process and equipment of the present invention.

In the preferred embodiment, the system 20 includes a mixer that prepares concrete that is deposited into the hopper 26, with the concrete then being fed into the hopper 32 of the production machine 30. However, other configurations of the system are possible. For example, the infeed conveyor 24 from the mixer could deposit mixed concrete directly into the hopper of the production machine. In this case, the surge hopper 26 would not be used and the mixer would function as the surge hopper. In such a system, a spray mechanism 40' and a blending mechanism 42', similar to the spray mechanism 40 and the blending mechanism 42, would be positioned above the conveyor 24, as shown in dashed lines in FIG. 2, and the conveyor 24 would discharge into the hopper of the production machine.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A process for producing color blended dry cast concrete comprising the steps of:

depositing dry cast concrete from a hopper onto a conveyor;

applying liquid pigment to dry cast concrete that has been discharged from the hopper; and blending the liquid pigment into the dry cast concrete on the conveyor to produce color blended concrete.

2. The process according to claim 1, wherein applying liquid pigment comprises applying a single color of liquid pigment.

3. The process according to claim 1, wherein applying liquid pigment comprises applying a plurality of colors of liquid pigment.

4. The process according to claim 1, wherein the constituent components of the dry cast concrete are mixed in the hopper.

5. The process according to claim 1, wherein the liquid pigment is applied as the dry cast concrete is conveyed by the conveyor.

6. The process according to claim 5, wherein blending occurs as the dry cast concrete with the liquid pigment applied thereto is conveyed by the conveyor.

7. The process according to claim 1, wherein the liquid pigment is applied by spraying it onto the dry cast concrete.

8. The process according to claim 7, wherein the spraying of the liquid pigment is continuous.

9. The process according to claim 1, wherein blending comprises stirring the liquid pigment into the dry cast concrete using at least one stirring mechanism.

10. The process according to claim 9, wherein blending comprises using a plurality of stirring mechanisms.

11. The process according to claim 9, wherein the stirring mechanism is rotatable.

12. A process for producing a color blended dry cast concrete product comprising the steps of:

depositing dry cast concrete from a hopper onto a conveyor;

applying liquid pigment to dry cast concrete that has been discharged from the hopper;

blending the liquid pigment into the dry cast concrete on the conveyor to produce color blended concrete;

conveying the color blended concrete to a concrete product production machine; and producing at least one concrete product from the color blended concrete in the concrete product production machine.

13. The process according to claim 12, wherein applying liquid pigment comprises applying a single color of liquid pigment.

14. The process according to claim 12, wherein applying liquid pigment comprises applying a plurality of colors of liquid pigment.

15. The process according to claim 12, Wherein the constituent components of the dry cast concrete are mixed in the hopper.

16. The process according to claim 12, comprising depositing the color blended concrete into a hopper of the concrete product production machine.

17. The process according to claim 12, wherein the concrete product production machine comprises a concrete block production machine, and further comprising producing at least one concrete block from the color blended concrete in the concrete block production machine.

18. The process according to claim 12, wherein the liquid pigment is applied as the dry cast concrete is conveyed by the conveyor.

19. The process according to claim 18, wherein blending occurs as the dry cast concrete with the liquid pigment applied thereto is conveyed to the concrete product production machine.

20. The process according to claim 12, wherein the liquid pigment is applied by spraying it onto the dry cast concrete.

21. The process according to claim 20 wherein the spraying of the liquid pigment is continuous.

22. The process according to claim 12, wherein blending comprises stirring the liquid pigment into the dry cast concrete using at least one stirring mechanism.

23. The process according to claim 22, wherein blending comprises using a plurality of stirring mechanisms.

24. The process according to claim 22, wherein the stirring mechanism is rotatable.

* * * * *